United States Patent [19]

Walklet

[11] 3,989,154

[45] Nov. 2, 1976

[54] STACKABLE AND NESTABLE TRAY FOR SHIPPING AND DISPLAYING ARTICLES

[75] Inventor: Mercer Donald Walklet, Belleair Beach, Fla.

[73] Assignee: McNeil Corporation, Akron, Ohio

[22] Filed: Nov. 4, 1975

[21] Appl. No.: 628,744

Related U.S. Application Data

[63] Continuation of Ser. No. 395,348, Sept. 7, 1973, abandoned.

[52] U.S. Cl. ..... 217/26.5; 206/507; 220/23.6; 229/2.5 EC; 229/29 M

[51] Int. Cl.[2] ..... B65D 21/04; B65D 1/34

[58] Field of Search ..... 206/507; 217/26.5, 25.5; 229/2.5, 29 M; 220/23.6

[56] References Cited

UNITED STATES PATENTS

| | | | |
|---|---|---|---|
| 1,956,955 | 5/1934 | Kronenberger | 217/26.5 |
| 1,967,040 | 7/1934 | Pickett | 217/26.5 |
| 2,071,545 | 2/1937 | Kronenberger | 217/26.5 |
| 2,100,516 | 11/1937 | Read | 217/26.5 |
| 2,351,754 | 6/1944 | Friday | 217/26.5 |
| 2,656,945 | 10/1953 | Grant | 217/26.5 |
| 3,000,528 | 9/1961 | Kuhl | 217/26.5 |
| 3,191,796 | 6/1965 | Schwartz | 206/507 |
| 3,337,110 | 8/1967 | Commisso | 229/29 M |
| 3,651,976 | 3/1972 | Chadbourne | 220/23.6 |

*Primary Examiner*—George E. Lowrance
*Attorney, Agent, or Firm*—Hamilton, Renner & Kenner

[57] ABSTRACT

The invention relates to trays for shipping and displaying fragile articles which can be stacked with other identical and similar trays and which can be nested with identical trays. The subject trays have a plurality of pockets adapted to receive the fragile articles, lower supports extending from the bottom of the pockets and terminating in lower bearing surfaces, and upper supports extending above the pockets and terminating in upper bearing surfaces, whereby the upper bearing surfaces support the lower bearing surfaces of other identical and similar trays to effect stacking.

11 Claims, 3 Drawing Figures

STACKABLE AND NESTABLE TRAY FOR SHIPPING AND DISPLAYING ARTICLES

This is a continuation of application Ser. No. 395,348, filed Sept. 7, 1973, now abandoned.

BACKGROUND OF THE INVENTION

The present invention relates generally to trays for shipping and displaying somewhat fragile articles such as fruit. More particularly, the invention relates to an improved tray construction which is capable of protecting such fragile articles from damaging forces which may be encountered during shipping, which permits nesting with identical trays and stacking with the same or similar trays, and which provides open access for loading, unloading and viewing the articles.

The bulk packaging of delicate or frangible foodstuff articles such as fruit, vegetables, eggs and the like has proven highly undesirable for a number of reasons. No matter what type of transportation is employed for shipping purposes, substantial vibration and other forces are necessarily administered to the articles during transit as well as during loading or unloading operations. The bulk packaging of quantities of the articles in contact with each other in a container increases these potentially damaging forces because of the mass of the articles acting on any individual article. The resulting bruises, lacerations or other deleterious effects are well known to persons skilled in the art and otherwise. In addition, such damage or that originated from other sources may produce a decay environment which is susceptible of transmission to other contacting but previously uninfected articles.

As a result of the above exemplary disadvantages attendant the bulk packaging of such foodstuff articles, there have been numerous suggested configurations for trays which have as their functional purpose the isolation of the individual articles so as to eliminate the disadvantages attendant the contacting deployment. In general, the proposed configurations have tended to address themselves to one of the numerous problems associated with the handling and display requirements of a tray configuration. In some instances provision has been made for the isolation of each individual article in a tray which requires the use of a layer of cardboard or other separating device to provide support between the stacked trays. Such a configuration has the decided disadvantage of requiring substantial quantities of separating devices which are relatively easily misplaced or damaged such that reuse is normally not feasible.

In other instances trays have been proposed which are of a two-part nature such that a lid or closure must be provided with open windows or other translucent material such as to accomplish the requisite display function. Such trays are generally more difficult to handle, require a longer time to load and unload, and to eliminate the possibility of separation of the two parts must be provided with some type of hinge arrangement which is subject to failure, thereby reducing the possibility of succesfully recycling devices any substantial number of times.

A great number of proposed prior art trays have structural characteristics such that the stacking of the trays in layers for shipping and/or display purposes places the bearing or supporting points of adjacent trays in substantial alignment with the article to be protected such that upon subjection to the forces described above, the trays can deform to a sufficient extent such that damage to the articles is nevertheless possible. In other instances the bearing or supporting points are of such limited size as to require the use for stacking of only exactly identical trays.

To applicant's knowledge, there is no existing tray configuration which solves the full range of problems discussed hereinabove to which the present invention is directed.

SUMMARY OF THE INVENTION

It is, therefore, an object of the present invention to provide a tray which combines desirable features for both shipping and displaying delicate or frangible foodstuff articles Another object of the present invention is to provide a tray for such articles which isolates each individual article from the others in a force absorbing environment. A further object of the invention is to provide a tray which can be vertically stacked, while loaded with such articles, with one or more identical or similar trays and transported without damaging the articles therein and which can be nested with identical trays by a reorientation such as reversing the ends when the articles have been unloaded.

Still another object of the present invention is to provide a series of trays having identical exterior dimensions with a number of article receiving pockets of substantially the same size, selected from a group of sizes, in any one tray. A still further object of the invention is to provide a tray which has a plurality of elongate lower supports below the article receiving pockets which will engage the upper supports of any of a series of trays having identical exterior dimensions to permit stacking of the trays when the pockets are loaded with the articles. Yet another object of the invention is to provide a tray having article receiving pockets the upper portions of which are outwardly flared to facilitate the loading and unloading of articles with respect to the pockets. Still another object of the invention is to provide a tray in which the pockets are formed in such a manner as to permit the circulation of air about a substantial portion of an article supported in a pocket. Yet a still further object of the invention is to provide a tray which is of sufficient strength and rigidity to withstand forces experienced during shipping and handling when loaded with articles, which may be of a small gauge light weight material, which is capable of being recycled or reused a substantial number of times, and which can be manufactured in substantial quantities relatively inexpensively.

In general a tray according to the concept of the present invention for shipping and displaying articles and being stackable with other identical and similar trays has a plurality of pockets adapted to receive and snugly hold the articles in protective isolation, lower supports extend from the bottom of the pockets and terminate in lower bearing surfaces, and upper supports extend above the pockets and terminate in upper bearing surfaces. The upper bearing surfaces are adapted to support the lower bearing surfaces of other identical and similar trays to effect stacking. The rotation of a tray through 180° in a horizontal plane from a stacked position on an identical tray positions the trays for nesting engagement.

A preferred and an exemplary alternate embodiment of trays according to the concept of the present invention are shown by way of example in the accompanying drawings and described in detail without attempting to show all of the various forms and modifications in which the invention might be embodied; the invention being measured by the appended claims and not by the details of the specification.

DESCRIPTION OF THE PREFERRED EMBODIMENT

Figure 1:
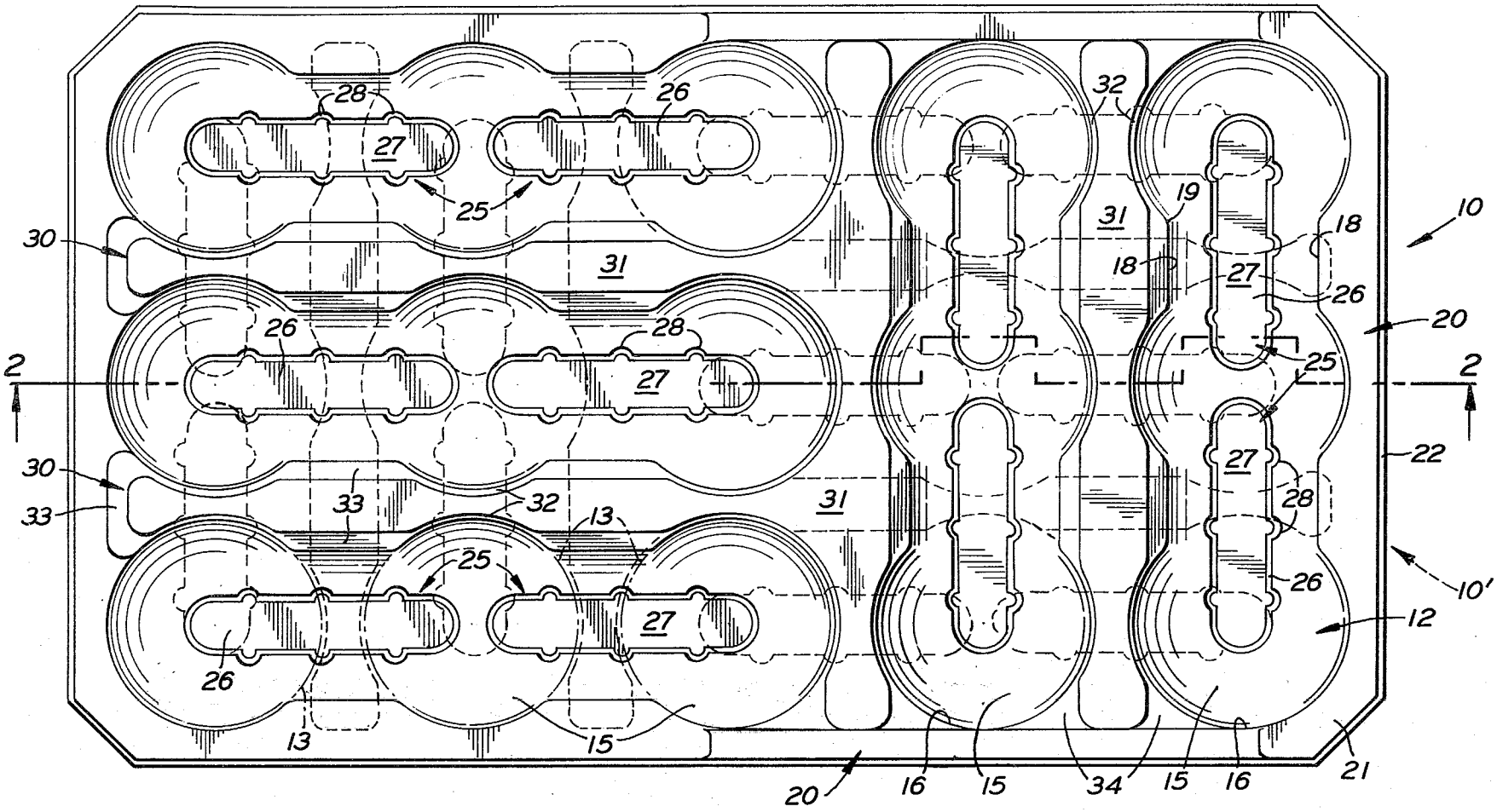
FIG. 1 is a top plan view of a tray according to the concept of the present invention depicted in stacked relation to an identical tray positioned thereunder.
Figure 2:
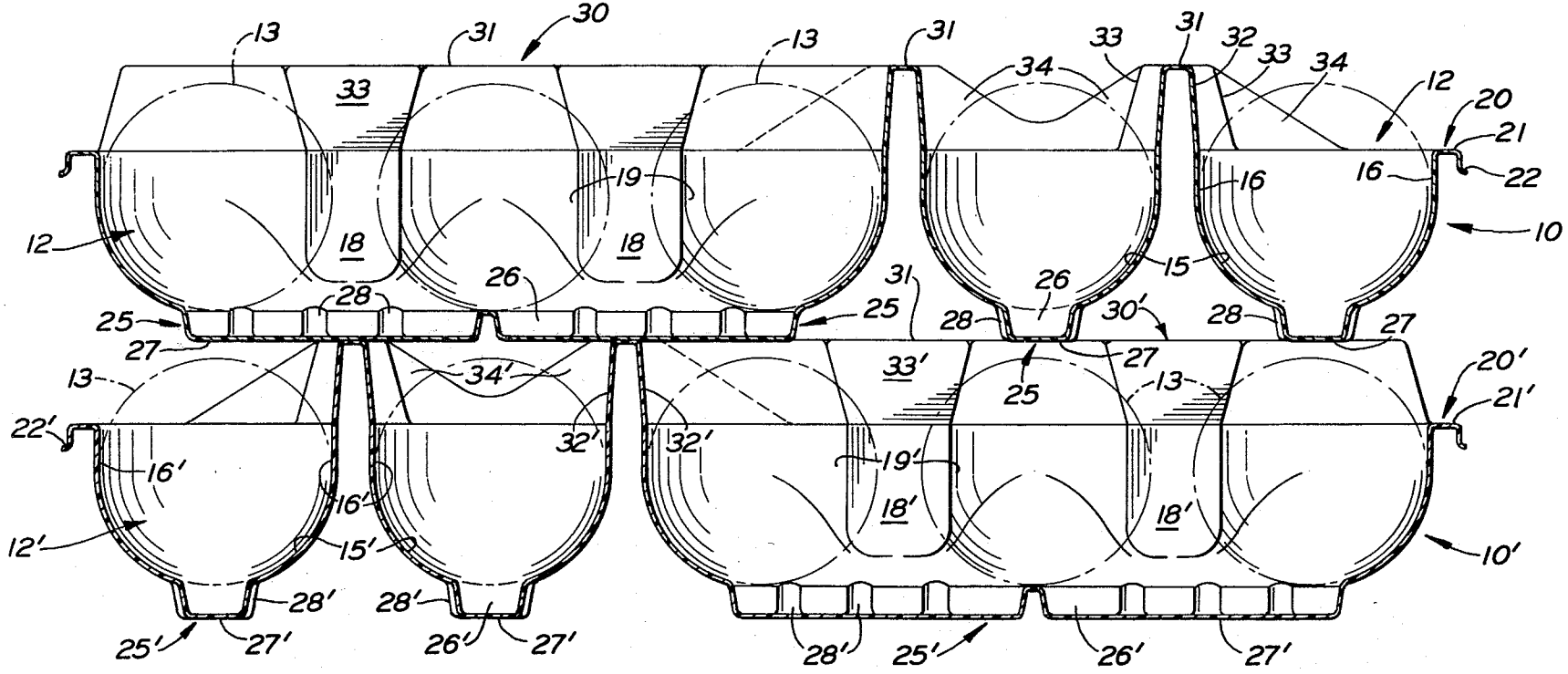
FIG. 2 is a cross sectional view taken substantially along the line 2—2 of FIG. 1 and showing additional details of the trays in their stacked relationship.

Referring now to the drawings and particularly FIGS. 1 and 2 thereof, an exemplary tray, generally indicated by the numeral 10, according to a preferred embodiment of the invention is depicted in juxtaposed vertical stacking arrangement to an identical tray, generally indicated by the numeral 10'. As shown, each of the trays 10, 10' have a plurality of pockets, generally indicated by the numerals 12 and 12', respectively, which may be of the same size to accomodate foodstuff articles such as fruit. For purposes of illustration, an article 13 which might be an orange is shown in chain lines in a pocket 12' in FIG. 2. The trays 10, 10' are depicted as having 15 pockets 12, 12'; however, more or less pockets could be provided depending upon the size of the trays 10, 10' and the pockets 12, 12'.

As best seen in FIG. 2, the article 13 is primarily supported in pockets 12, 12' by lower walls 15 and 15' which are preferably of a generally spherical configuration and may constitute substantially a half-sphere boundary adapted to snugly receive an article 13 of substantially the same diameter. For purposes of providing ample lateral restraint to ensure that an article 13 remains seated in the lower walls 15, 15', the pockets may have intermediate walls 16, 16' which may be substantially vertical, as shown, or taper slightly outwardly in such a manner as to constitute somewhat of a mouth portion of the pockets 12, 12'. To facilitate the loading and unloading of trays 10, 10', each of the pockets 12, 12' are preferably spaced from and joined with at least one other pocket by means of opposed spacer walls 18 and 18' which define an upwardly open channel between the pockets. The walls may be substantially vertical and extend substantially to the bottom of the pockets 12, 12' into which they are merged by smoothly curved surfaces 19 and 19'.

The lateral outer limits of trays 10 and 10' are defined by peripheral rims, generally indicated by the numerals 20 and 20', respectively. For the purpose of construction convenience, the rims 20, 21' may depend outwardly from the upper extremities of the peripheral intermediate walls 16, 16' of the pockets 12, 12' as substantially lateral ledges 21 and 21'. In order to provide improved peripheral rigidity to the trays 10, 10' the rims 20, 20' may have generally downwardly and laterally projecting reinforcing flanges 22 and 22' extending from lateral edges 21, 21' respectively.

The trays 10, 10' have lower supports, generally indicated by the numerals 25 and 25', which may be generally channel-shaped members 26 and 26' which may be integrally formed with the pockets 12, 12', depend downwardly therefrom as viewed in the Figs., and open thereinto. The channel-shaped members 26, 26'terminate at their lower extremity as viewed in the Figs. in lower bearing surfaces 27 and 27' and, as can be seen in FIG. 1, are preferably of generally uniform width and of substantial length, preferably sufficient to communicate with at least two of the pockets 12, 12', and the channel therebetween formed by walls 18, 18' for supporting tray 10 when it is loaded with articles and positioned on a flat surface or, as will be hereinafter apparent, on another tray of identical or similar configuration. It should be noted that air is advantageously capable of circulating to the lower portions of article 13 seated in pockets 12, 12' by virtue of ingress and egress through the channels formed by walls 18, 18'and along the channel-shaped members 26, 26' of lower supports 25, 25'. Channel-shaped members 26, 26' may be provided with one or embossments 28 and 28' to impart improved vertical strength and rigidity thereto.

The trays 10, 10' have upper supports, generally indicated by the numerals 30 and 30', respectively, which extend vertically upward from the pockets 12, 12' and form upper bearing surfaces 31 and 31'. The combined vertical height of the upper supports 30, 30', the intermediate walls 16, 16', and the lower walls 15, 15' is at least equal to the diameter of an article 13 so that upper bearing surfaces 31, 31' are in the same horizontal plane with or above the upper extremity of an article 13 reposing in pockets 12, 12'. Preferably, the upper supports 30, 30' or intermediate walls 16, 16' are of sufficient vertical height such that upper bearing surfaces 31, 31' are a distance above an article 13 in pockets 12, 12' as seen in FIG. 2. This construction has the advantage that a degree of clearance is provided between an article 13 and the lower bearing surfaces 27 of a tray stacked thereon as can be seen in FIG. 2. Such clearance can prevent damage to article 13 in the event that a particular article 13 is of somewhat oblong configuration or that the trays 10, 10' are subjected to sufficient loading forces such as to cause some degree of structural deformation.

The upper supports 30, 30' have side walls 32 and 32'which connect the intermediate walls 16, 16' and the upper bearing surfaces 31, 31' in the area proximate the pockets 12, 12'. Side walls 32, 32' are preferably tapered slightly outwardly as compared with intermediate walls 16, 16' but are generally curvilinearly configured to conform with the portion of the pockets 12, 12' which are intercepted to serve as a guide for positioning articles in the pockets. In the area between pockets 12, 12' connecting walls 33 and 33' extend upwardly from the opposed spacer walls 18, 18' and join side walls 32, 32' of adjacent pockets 12, 12'. The connecting walls 33, 33' may be substantially flat and are preferably tapered outwardly at a greater angle than side walls 32, 32' to permit more freedom of access to the channel formed by spacer walls 18, 18', as for the insertion of a person's hand for ease of loading and unloading the trays 10, 10'. In respect to the pockets adjoining the perimeter of trays 10, 10', the side walls 32, 32' may be extended to form webs 34, 34' which afford additional structural support and rigidity to the trays 10, 10'.

From the above description of the trays 10, 10' depicted in FIGS. 1 and 2 of the drawings, it is evident that the tray 10 when positioned as depicted in the drawings may be firmly and securely stacked atop the tray 10' in such a manner that the lower bearing surfaces 27 of tray 10 are supported over a portion of their extent by a portion of the extent of the upper bearing surfaces 31' of the lower tray 10'. It should also be noted that if upper tray 10 is turned end for end, i.e., rotated 180° in a horizontal plane, the trays 10 and 10' being identical will interfit or nest with the articles removed to conserve space for shipping the trays alone. It may be noted by reference to FIG. 1 that the length of upper bearing surfaces 31' and lower bearing surfaces 27 are such that supporting engagement is affected to at least some substantial extent when trays 10 and 10' are slightly out of exact vertical alignment. This feature may have significance in instances where the trays are stacked without the benefit of the walls of a retaining container adapted to receive a plurality of the trays or in instances where a plurality of the trays are positioned for display purposes on a platform which is inclined to the horizontal to some extent for purposes of facilitating the viewing of articles in the trays as may be the case in certain types of display cabinets.

Figure 3:
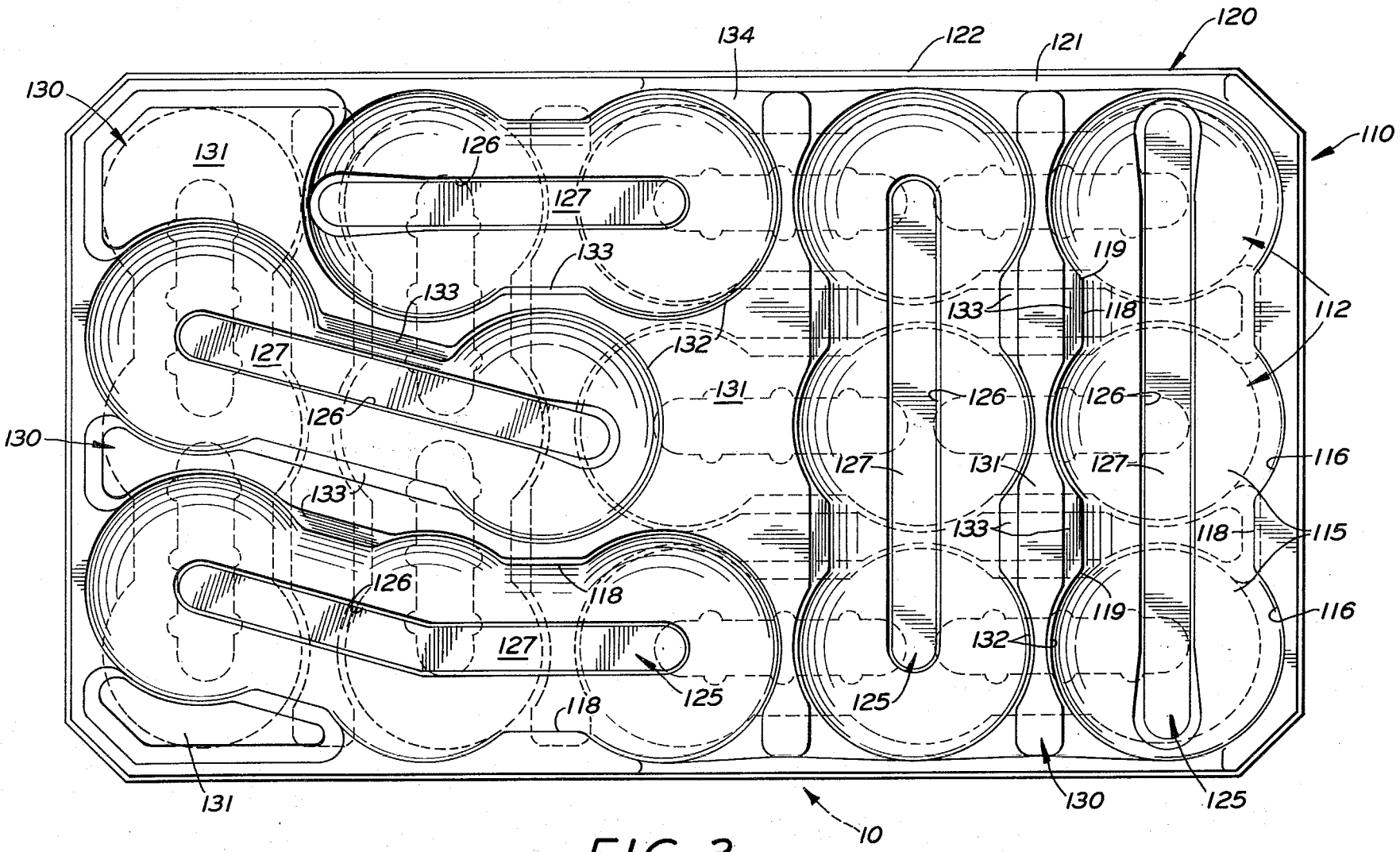
FIG. 3 is a top plan view of a tray depicting an exemplary additional embodiment according to the present invention similar to the tray of FIGS. 1 and 2 but having pockets of a different size arranged in a different geometric configuration to accomodate articles of a different size and shown in stacked relation above a tray according to the embodiment of FIGS. 1 and 2.

Referring now to FIG. 3 of the drawings, another embodiment of tray, generally indicated by the numeral 110, is depicted in vertical stacked relation above a tray of the construction of FIGS. 1 and 2 of the drawings as described hereinabove. As shown, the tray 110 has a plurality of pockets, generally indicated by the numeral 112 which may be of the same size to accomodate foodstuff articles such as fruit in a manner comparable to the trays 10, 10' described above. The tray 110 is depicted as having 13 pockets 112 which is necessitated due to the fact that the outside dimensions are in all respects identical to the trays 10, 10' while the size of the pockets 112 are substantially larger than the pockets 12, 12'.

An article is primarily supported in the pockets 112 by lower walls 115 which are preferably of a generally spherical configuration and may constitute substantially a half-sphere boundary adapted to snugly receive an article of substantially the same or slightly lesser diameter. For purposes of providing ample lateral restraint to insure that the articles remain seated in the lower walls 115, the pockets may have intermediate walls 116 comparable to the walls 16, 16' of the trays 10, 10' as depicted in FIGS. 1 and 2. Each of the pockets 112 are preferably spaced from the joined with at least one other pocket by opposed spacer walls 118 which define an upwardly open channel between the pockets. In a manner comparable to walls 18 and 18' the walls 118 may be substantially vertical and extend substantially to the bottom of pockets 112 into which they are merged by smoothly curved surfaces 119.

The lateral outer limits of the tray 110 are defined by a peripheral rim, generally indicated by the numeral 120. The rim 120 may depend outwardly from the upper extremity of the intermediate walls 116 of pockets 112 as a substantially lateral ledge 121. In a manner comparable to rims 20, 20', the rim 120 may have a generally downwardly and laterally projecting reinforcing flange 122 extending from lateral ledge 121.

The tray 110 also has lower supports, generally indicated by the numeral 125, which may be generally channel-shaped members 126 depending downwardly from the pockets 112. The channel-shaped members 126 terminate in lower bearing surfaces 127 which are of generally uniform width and preferably sufficient length to communicate with at least two of the pockets 112 and the channel therebetween formed by walls 118 to provide bottom support for the tray 110.

The tray 110 has upper supports, generally indicated by the numeral 130 which extend vertically upward from the pockets 112 and form upper bearing surfaces 131. In a manner similar to the configuration of the trays 10, 10', the upper supports 130 and the intermediate walls 116 are of sufficient vertical height such as to provide a clearance between the upper bearing surfaces 131 and the upper extremity of articles in the pockets 112. The upper supports 130 have side walls 132 which connect intermediate walls 116 and the upper bearing surfaces 131 in the area proximate the pockets 112, 112'. Side walls 132 are preferably tapered slightly outwardly as compared with intermediate walls 116 but are generally curvilinearly configured to conform with the portion of pockets 112 which are intercepted to serve as a guide for positioning articles in the pockets. In the area between pockets 112, connecting walls 133 extend upwardly from the opposed spaced walls 118 and join side walls 132 of adjacent pockets 112. The connecting walls 133 may be substantially flat and are preferably tapered outwardly at a greater angle than side walls 132 for the purpose described in conjunction with the discussion of the corresponding elements of FIGS. 1 and 2. In respect to the pockets adjoining the perimeter of the tray 110 the side walls 132 may be extended to form webs 134 which afford additional structural support and rigidity to the tray 110.

From the above description of the tray 110 and the previous description of tray 10 in conjunction with FIGS. 1 and 2, it is evident that the tray 110 when positioned as depicted in FIG. 3 may be firmly and securely stacked atop a tray 10 in such a manner that the lower bearing surfaces 127 of tray 110 are supported over a portion of their extent by a portion of the extent of the upper bearing surfaces 31 of the lower tray 10. It may also be appreciated from a reference to FIG. 3 that the position of the trays can be reversed such that the tray 10 could be securely stacked atop the tray 110. FIG. 3 and the above description thereof are accordingly significant as a depiction of a lay-out of pockets in a tray of the type contemplated wherein the pockets do not follow a regular geometric orientation. It should further be appreciated that various other regular or irregular geometric lay-outs could be made depending upon the overall dimensions of the trays and the size of the pockets by employing the construction features described hereinabove. Additionally, trays could be configured having pockets of two or more different sizes of either one or two piece construction, all without departing from the spirit of the instant invention.

What is claimed is:

1. A tray for shipping and displaying a plurality of articles which is stackable with other identical and similar trays comprising, a plurality of pocket means adapted to receive the articles, opposed spacer walls joining each of said plurality of pocket means to at least one other of said pocket means, lower support means extending from the bottom of said pocket means and communicating with at least two of said pocket means, lower bearing surface means on said lower support means, upper support means extending above and disposed between certain of said pocket means, and upper bearing surface means on said upper support means adapted to engage a portion of each lower bearing surface means of other identical and similar trays to effect stacking.

2. A tray according to claim 1, in which said lower bearing surface means are spaced a distance below said pocket means.

3. A tray according to claim 2, in which said lower support means are channel-shaped members which openly communicate with said pocket means.

4. A tray according to claim 3, in which said channel-shaped members have substantially vertical embossments providing additional strength and rigidity thereto.

5. A tray according to claim 1, in which only a portion of said upper bearing surface means engages the lower bearing surface means of other identical and similar trays.

6. A tray according to claim 1, in which said upper bearing surface means engages only portions of said lower bearing surface means of the other identical similar trays displaced from said pocket means to effect stacking.

7. A tray according to claim 1, in which said pocket means have generally spherical lower walls and substantially vertical intermediate walls forming a mouth portion of said pocket means.

8. A tray according to claim 7, in which said opposed spacer walls communicate with an open channel formed by said lower support means.

9. A tray according to claim 7, including a peripheral rim having reinforcing flanges extending outwardly of said intermediate walls.

10. A tray according to claim 1, in which said upper support means has side walls connecting said pocket means and said upper bearing surface means to position the articles in said pocket means.

11. A tray according to claim 10, in which said side walls conform with said pockets and connecting walls joining said side walls are tapered outwardly at a greater angle than said side walls to facilitate access therethrough.

* * * * *

UNITED STATES PATENT OFFICE
CERTIFICATE OF CORRECTION

PATENT NO. : 3,989,154
DATED : Nov. 2, 1976
INVENTOR(S) : Mercer Donald Walklet

It is certified that error appears in the above-identified patent and that said Letters Patent are hereby corrected as shown below:

Col. 7, Line 23, after "identical" insert --and--.

Signed and Sealed this

Eleventh Day of January 1977

[SEAL]

*Attest:*

RUTH C. MASON
*Attesting Officer*

C. MARSHALL DANN
*Commissioner of Patents and Trademarks*